US008016295B2

(12) United States Patent
Guest et al.

(10) Patent No.: US 8,016,295 B2
(45) Date of Patent: Sep. 13, 2011

(54) HELICAL BACKUP ELEMENT

(75) Inventors: Randall V. Guest, Spring, TX (US); Marc N. Samuelson, Houston, TX (US); Justin P. Vinson, Houston, TX (US); Dennis E. Kroll, League, TX (US)

(73) Assignee: Baker Hughes Incorporated, Houston, TX (US)

( * ) Notice: Subject to any disclaimer, the term of this patent is extended or adjusted under 35 U.S.C. 154(b) by 187 days.

(21) Appl. No.: 12/123,073

(22) Filed: May 19, 2008

(65) Prior Publication Data

US 2009/0126925 A1 May 21, 2009

Related U.S. Application Data

(60) Provisional application No. 60/942,084, filed on Jun. 5, 2007.

(51) Int. Cl.
*F16J 15/16* (2006.01)
*F16J 9/06* (2006.01)

(52) U.S. Cl. ..... 277/584; 277/610

(58) Field of Classification Search ..... 277/450, 277/458, 528, 610, 584; 267/166, 167
See application file for complete search history.

(56) References Cited

U.S. PATENT DOCUMENTS

| | | | | | |
|---|---|---|---|---|---|
| 485,407 | A | * | 11/1892 | Ethridge | 277/467 |
| 563,445 | A | * | 7/1896 | Bryant | 277/528 |
| 567,233 | A | * | 9/1896 | Gruber | 277/528 |
| 1,161,851 | A | * | 11/1915 | Downie | 92/249 |
| 1,991,893 | A | * | 2/1935 | Flick et al. | 428/376 |
| 2,749,193 | A | * | 6/1956 | Traub | 277/458 |
| 2,776,154 | A | * | 1/1957 | Leistensnider | 277/528 |
| 2,809,080 | A | * | 10/1957 | Mittell et al. | 277/458 |
| 4,239,245 | A | * | 12/1980 | Giglio et al. | 277/528 |
| 4,431,197 | A | * | 2/1984 | Kirkwood | 277/610 |
| 5,123,662 | A | * | 6/1992 | Sugimura | 277/584 |
| 5,311,938 | A | | 5/1994 | Hendrickson et al. | |
| 6,651,738 | B1 | | 11/2003 | Solfronk et al. | |
| 6,712,153 | B2 | | 3/2004 | Turley et al. | |
| 6,796,376 | B2 | | 9/2004 | Frazier | |

OTHER PUBLICATIONS

Guoynes, J.C.; "New Composite Fracturing Plug Improves Efficiency in Coalbed Methane Completions". Halliburton Energy Services, Inc.; SPE 40052. Apr. 5-8, 1998. pp. 603-613.

* cited by examiner

*Primary Examiner* — Giovanna Wright
(74) *Attorney, Agent, or Firm* — Cantor Colburn LLP

(57) ABSTRACT

A helical backup element includes a tubular body of material and a helical opening in the tubular body.

12 Claims, 3 Drawing Sheets

HELICAL BACKUP ELEMENT

CROSS REFERENCE TO RELATED APPLICATION

The present application claims priority to United States Provisional Patent Application Ser. No. 60/942,084, filed Jun. 5, 2007, the entire contents of which are specifically incorporated herein by reference.

BACKGROUND

Utilization of Packers and other angular sealing type devices to seal annular spaces between tubular members have been employed in various industries for a relatively long period of time. One industry utilizing such seals is the hydrocarbon recovery industry, which generally utilizes many annular sealing devices (packers, etc.) for various purposes in the wellbore. While available, annular sealing devices work well for their intended purpose. A common consideration for the use of and selection of a type of annular seal is the risk of extrusion of the sealing element axially due to pressure differential across the seal. For this reason, the art has developed a number of different types of backup rings whose purpose is to reduce the radial dimension of the annulus between two tubular components so that extrusion gap is narrowed thereby making extrusion less likely.

Prior art backup elements generally rely upon conical components that are splayed open to a large diameter when compressed. This requires at least a stretchable, if not resilient property, to be retained in the material used as the backup. While such resilient properties enable these devices to function, they also are the Achilles' heel of the device because they do not provide sufficient rigidity to prevent extrusion of the primary seal in some conditions.

Other prior art elements utilize metal backup rings but they tend to be more complex requiring multiple petals or other interactive structures allowing them to attain a larger diametrical dimension upon axial compression. Such metal elements are more costly and have a relatively narrow adaptiveness and unexpected conditions at the point of use.

As the industry will continue to require backup rings for the foreseeable future to prevent primary element extrusion, the art will well receive an improved backup element.

SUMMARY

A helical backup element includes a tubular body of material and a helical opening in the tubular body.

A sealing element backup system includes a tubular body of material; a helical opening in the tubular body; and at least one frustoconical surface in operable communication with the tubular body.

BRIEF DESCRIPTION OF THE DRAWINGS

Referring now to the drawings wherein like elements are numbered alike in the several Figures.

DETAILED DESCRIPTION

Figure 1:
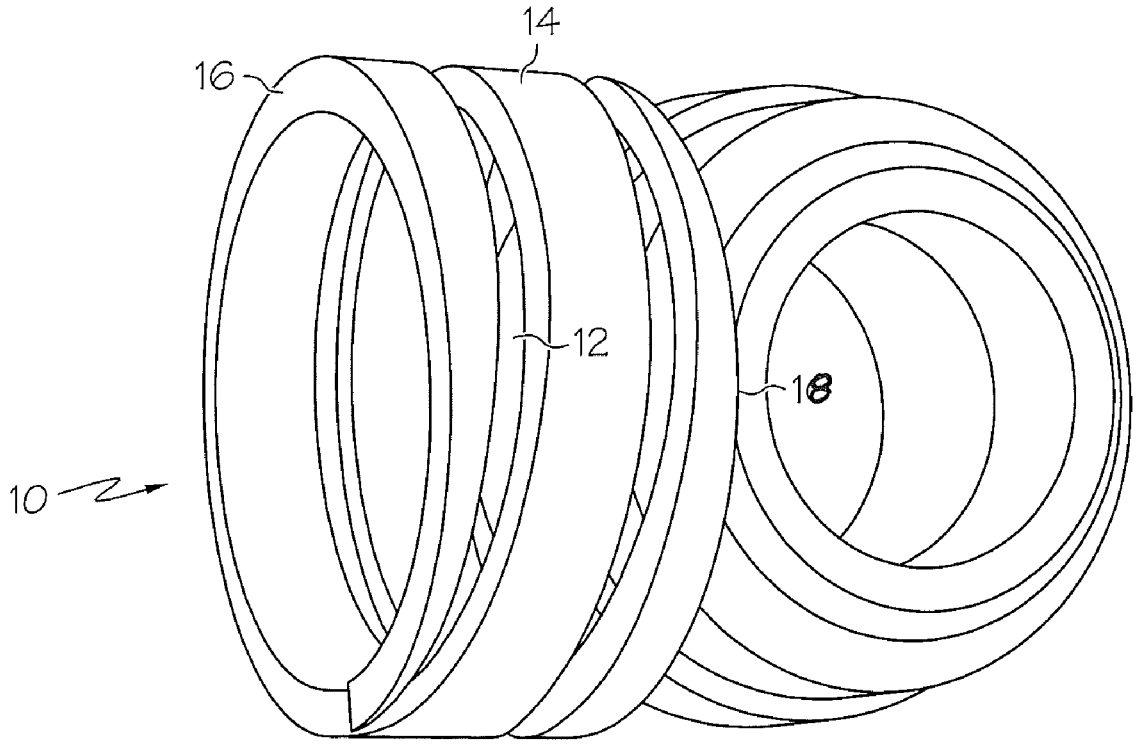
FIG. 1 is a perspective view of the helical backup element as disclosed herein.
Figure 2:
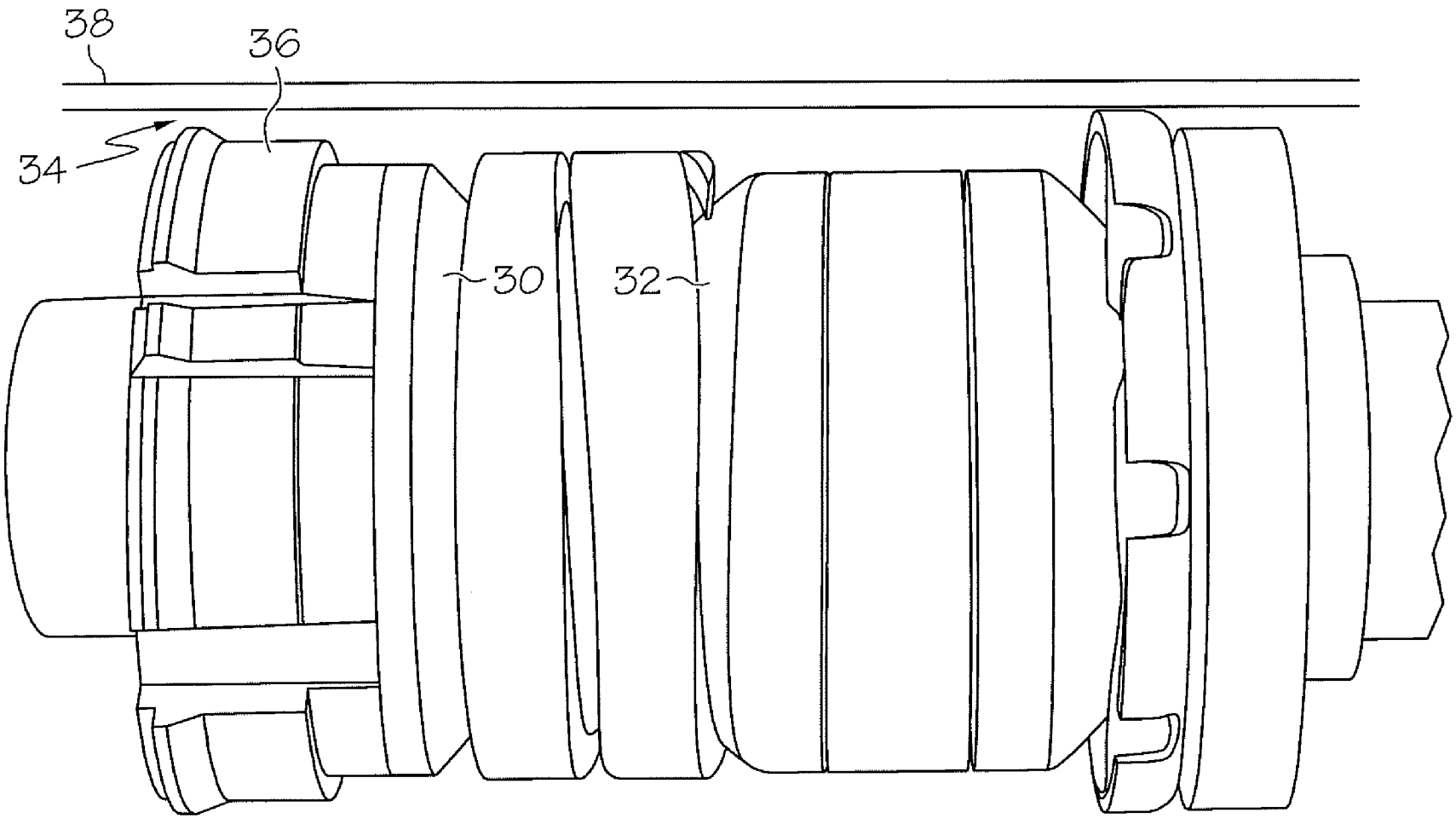
FIG. 2 is a side view of the helical backup element disclosed herein disposed adjacent to primary sealing elements on a downhole tool.

Referring to FIGS. 1 and 2, it will be appreciated that a tubular form backup element 10 is represented having a helical opening 12 extending the length thereof. The helical opening 12 creates individual turns 14 of material that may have either a fixed width (but for the end cuts which are orthogonal to the axis of the device thereby necessarily causing the turns to reduce in width) as illustrated in FIG. 1 or may be of varying width along the axial length of the backup element 10. Exemplary full widths for the element 10 are from about ⅛ inch to about ¾ inch, in one embodiment. While some embodiments require limitation to the foregoing range, such limitation does not apply to all embodiments. As illustrated, only about two of the turns of the element 10 are full width. The balance of the otherwise three illustrated turns are of steadily narrowing width due to the orthogonal end cut 16 and orthogonal end cut 18 of the element 10. It is to be appreciated that a greater number of turns 14 are possible and contemplated in connection with the invention. In some embodiments, end cuts 16 and 18 will each have faces that are not orthogonal to the axis of the element 10 but rather are frustoconically angled faces. Such angular faces will assist, in some embodiments, with radially outward movement of the element 10.

The element 10, in one embodiment, comprises a composite material and binder. The material requires properties of structural integrity with relatively high tensile and shear resistance. The binder is to be selected to have sufficient cohesive strength and to be resistant to temperature, pressure and caustic fluids to stay intact while in the downhole environment. Examples of composites that meet the foregoing requirements are epoxy, phenolic, vinylester or other binders with carbon, aramid, glass, ceramic or other reinforcement and combinations including at least one of the foregoing. Choice of binder and reinforcement is tailored to the target application: temperature, pressure and chemical nature of the use-environment. It is to be appreciated that this is not an exhaustive list.

Figure 3:
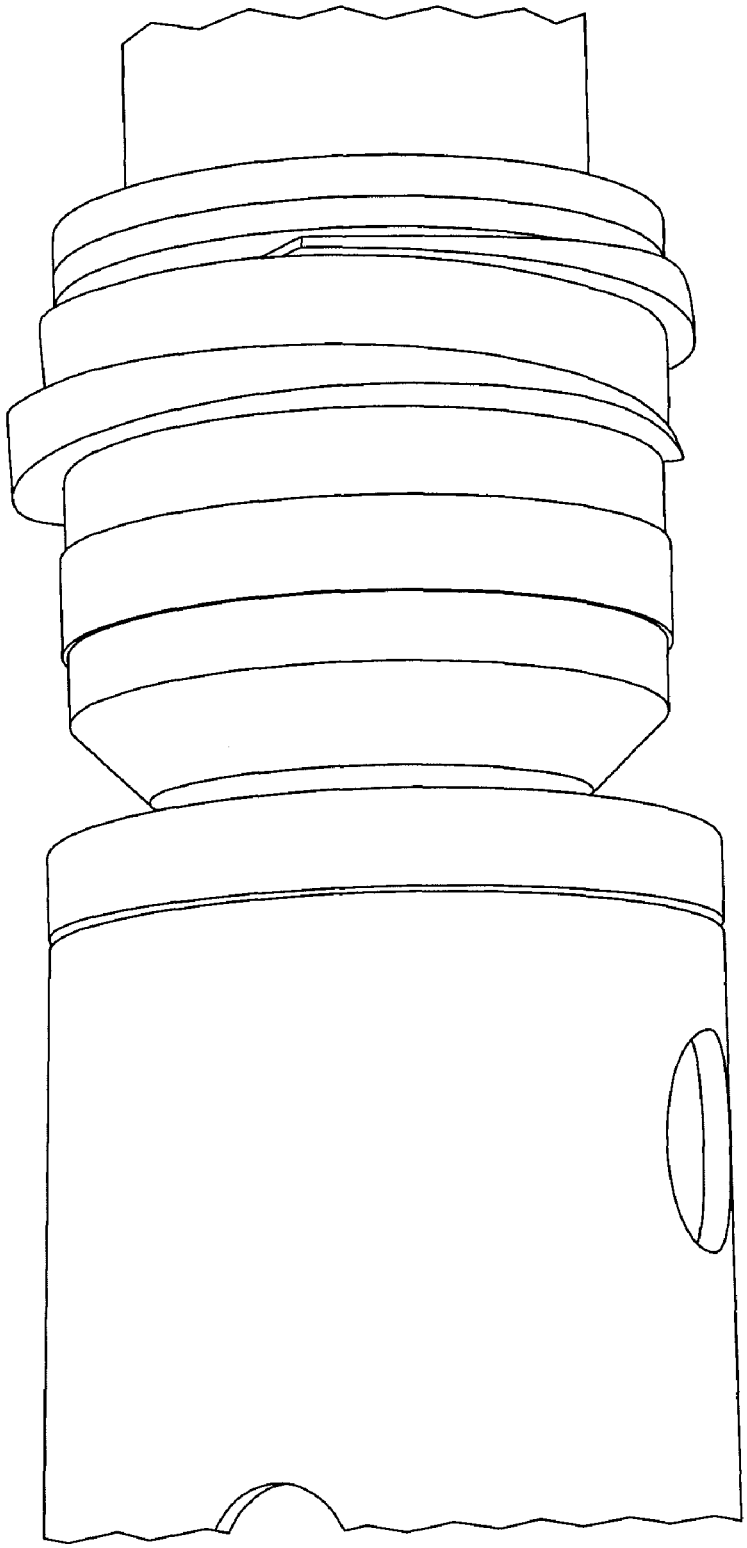
FIG. 3 is an elevation view of the helical backup element as disclosed herein in an axially compressed state adjacent to the primary seal to illustrate action of the helical backup element.

In operation, the element 10 appears as it does in FIG. 3. Upon review of the figure, it will be apparent that some sections of the element 10 have moved out of axial register with other sections of element 10. In addition, it is to be noted that the overall outside dimension of element 10 is greater when the element is under axial compression (as illustrated in FIG. 3) than it is when not axially loaded, as in FIG. 2. Careful consideration of the distinction in overall outside dimension of element 10 in FIG. 2 and FIG. 3 will make this apparent to one of ordinary skill in the art. The outside dimension growth of element 10 is due primarily to two major initiators. The first is the helical configuration of element 10. Upon axial compression element 10, the helical surfaces at the sides of each turn 14 will tend to slip past one another in an unwinding direction relative to element 10. One of skill in the art will recognize that if one unwinds a coiled spring, the outside dimension of the coil spring will grow. This is one property being utilized in connection with the present action. In addition to this unwinding action, in one embodiment element 10 is caused to ride up on at least one frustoconical surface, illustrated with two surfaces 30 and 32 in FIG. 2. Such surfaces will quite clearly urge element 10 in a radially outward direction and due to the helical nature of element 10, resistance to such radially outwardly directed motion is minimal. This is desirable since the overall intent for element 10 is indeed to grow an outside dimension thereby occupying the annular space 34 between the downhole tool (see 36 for example in FIG. 2) and a tubular member 38 within which the downhole tool 36 is to be installed. Because the composite materials indicated above are more rigid than the types of materials of the prior art that are usable through resilience, the element 10 provides superior extrusion resistance under all conditions.

While an embodiment of the invention has been described with respect to composite materials, it is also important to note that appropriate single materials, such as metallic, polymer, or even felted-fiber materials could be used to fabricate the backup element 10. Providing that the material is possessed of strength characteristics facilitating the helically induced radial expansion based upon axially applied load, the material 10 will work, as does the composite element discussed above.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A backup device comprising:

a helical backup element including a tubular body of material having at least one frustoconical end surface configured to assist in causing radial outward movement of the element in response to axial compression thereagainst; and a helical opening in the tubular body.

2. The element as claimed in claim 1 wherein the helical opening forms substantially fixed width turns of the helical body.

3. The element as claimed in claim 2 wherein a fixed width ranges from about ⅛ inch to about ¾ inch.

4. The element as claimed in claim 1 wherein the helical opening forms varying width turns of the helical body.

5. The element as claimed in claim 1 wherein the material comprises a composite material including a binder.

6. The element as claimed in claim 5 wherein the composite material is an aramid epoxy composite.

7. The element as claimed in claim 1 wherein the material comprises a metal.

8. The element as claimed in claim 1 wherein the body comprises three turns.

9. The element as claimed in claim 1 wherein the element is expandable radially outwardly responsive to axially oriented compression.

10. The element as claimed in claim 1 wherein the radial outward movement is in response to unwinding of the helical shape of the tubular body.

11. A sealing element backup system comprising: a helical backup element including a tubular body of material having at least one frustoconical end surface configured to assist in causing radial outward movement of the tubular body in response to axial compression thereagainst;

a helical opening in the tubular body; and at least one frustoconical surface in operable communication with the tubular body.

12. The system as claimed in claim 11 wherein the at least one frustoconical surface is two frustoconical surfaces in opposing relationship to one another.

* * * * *